US007503836B2

(12) United States Patent
Takeichi et al.

(10) Patent No.: US 7,503,836 B2
(45) Date of Patent: Mar. 17, 2009

(54) METHOD OF DRESSING GRINDSTONE FOR PROCESSING EYEGLASS LENS, AND DRESSING TOOL USED IN THE METHOD

(75) Inventors: Kyoji Takeichi, Gamagori (JP); Hirokatsu Obayashi, Aichi (JP); Ryoji Shibata, Toyokawa (JP)

(73) Assignee: Nidek Co., Ltd., Aichi (JP)

( * ) Notice: Subject to any disclaimer, the term of this patent is extended or adjusted under 35 U.S.C. 154(b) by 0 days.

(21) Appl. No.: 11/730,605

(22) Filed: Apr. 3, 2007

(65) Prior Publication Data

US 2007/0232204 A1 Oct. 4, 2007

(30) Foreign Application Priority Data

Apr. 3, 2006 (JP) ..... P2006-101564

(51) Int. Cl.
*B24B 53/04* (2006.01)

(52) U.S. Cl. ..... 451/56; 451/443

(58) Field of Classification Search ..... 451/56, 451/443, 444; 125/11.01

See application file for complete search history.

(56) References Cited

U.S. PATENT DOCUMENTS

| | | | | |
|---|---|---|---|---|
| 4,607,459 | A * | 8/1986 | Rees | 451/241 |
| 5,643,052 | A | 7/1997 | Delattre et al. | |
| 6,048,258 | A | 4/2000 | Shibata et al. | |
| 6,478,657 | B1 | 11/2002 | Shibata | |
| 6,503,615 | B1 * | 1/2003 | Horii et al. | 428/316.6 |
| 6,592,431 | B2 | 7/2003 | Mizuno et al. | |
| 6,991,527 | B2 * | 1/2006 | Linzell | 451/523 |

FOREIGN PATENT DOCUMENTS

| | | | |
|---|---|---|---|
| GB | 1-063-999 | A | 4/1967 |
| JP | 06-047664 | A | 2/1994 |
| JP | 09-029632 | A | 2/1997 |
| JP | 2004-107674 | A | 4/2004 |

* cited by examiner

*Primary Examiner*—Robert Rose
(74) *Attorney, Agent, or Firm*—Sughrue Mion, PLLC

(57) ABSTRACT

A method of dressing a grindstone for processing an eyeglass lens, comprises the step of pressing a melamine resin foam, which is used as a dressing tool, against a rotating grindstone.

4 Claims, 4 Drawing Sheets

METHOD OF DRESSING GRINDSTONE FOR PROCESSING EYEGLASS LENS, AND DRESSING TOOL USED IN THE METHOD

BACKGROUND OF THE INVENTION

The present invention relates to a method of dressing a grindstone for processing an eyeglass lens and a dressing tool used in the method.

A processing apparatus, which includes a roughing grindstone and a finishing (finish-edging) grindstone, has been used as an eyeglass lens processing apparatus for processing the periphery of the eyeglass lens. The processing apparatus may further include a polishing grindstone. When the grindstone has been used to process plenty of lenses, grinding efficiency deteriorates due to the separation, abrasion, and clogging of abrasive grains on the surface of the grindstone.

An operation called as dressing is performed to arrange the shape of the surface of the grindstone. In the related art, a rod-shaped or disk-shaped dressing stone is pressed against a rotating grindstone to perform dressing. Further, a cloth, on which an abrading agent is applied, is pressed against the rotating grindstone to perform the dressing.

However, the method using the hard dressing stone is inferior to the method using the abrading agent in result after the dressing. Further, there is a concern that the surface of the polishing grindstone becomes coarse. Meanwhile, since the cloth is burned out due to frictional heat or is wound on the rotating grindstone, it is not easy to perform the method using the abrading agent.

SUMMARY OF THE INVENTION

It is an object of the invention to provide a method of dressing a grindstone processing an eyeglass lens in which dressing is performed easily and appropriately, and a dressing tool used in the method.

In order to achieve the object, the invention is characterized by having the following structure.

(1) A method of dressing a grindstone for processing an eyeglass lens, the method comprising the step of:

pressing a melamine resin foam, which is used as a dressing tool, against a rotating grindstone.

(2) The method according to (1), further comprising the step of:

applying an abrading agent on the melamine resin foam.

(3) The melamine resin foam used in the method according to (1) that is mounted at a substantial end of a grip.

(4) The melamine resin foam according to (3), wherein at least a portion of a surface of the melamine resin foam has a curved shape substantially corresponding to a curved shape of an outer peripheral surface of a cylindrical grindstone, and at least a portion of a surface of an attachment part of the grip also has a curved shape substantially corresponding to the curved shape of the outer peripheral surface of the grindstone.

(5) The melamine resin foam used in the method according to (1), wherein at least a portion of a surface of the melamine resin foam has a curved shape substantially corresponding to a curved shape of an outer peripheral surface of a cylindrical grindstone.

(6) The melamine resin foam used in the method according to (1) on which abrading agent is applied.

(7) The melamine resin; foam according to (6) that is covered with a protecting member to prevent the abrading agent from deteriorating, before use.

DESCRIPTION OF THE PREFERRED EMBODIMENTS

Figure 1A:
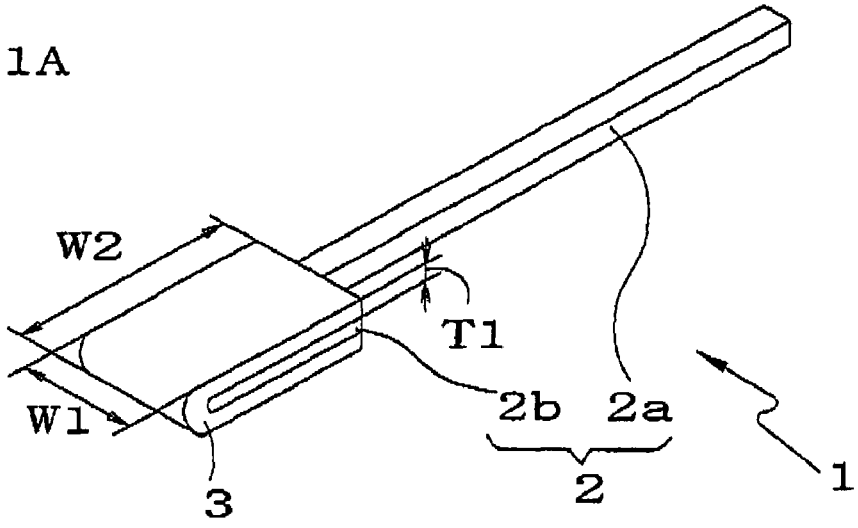
FIGS. 1A and 1B are views showing a schematic appearance of a dressing tool according to an embodiment of the invention.
Figure 1B:
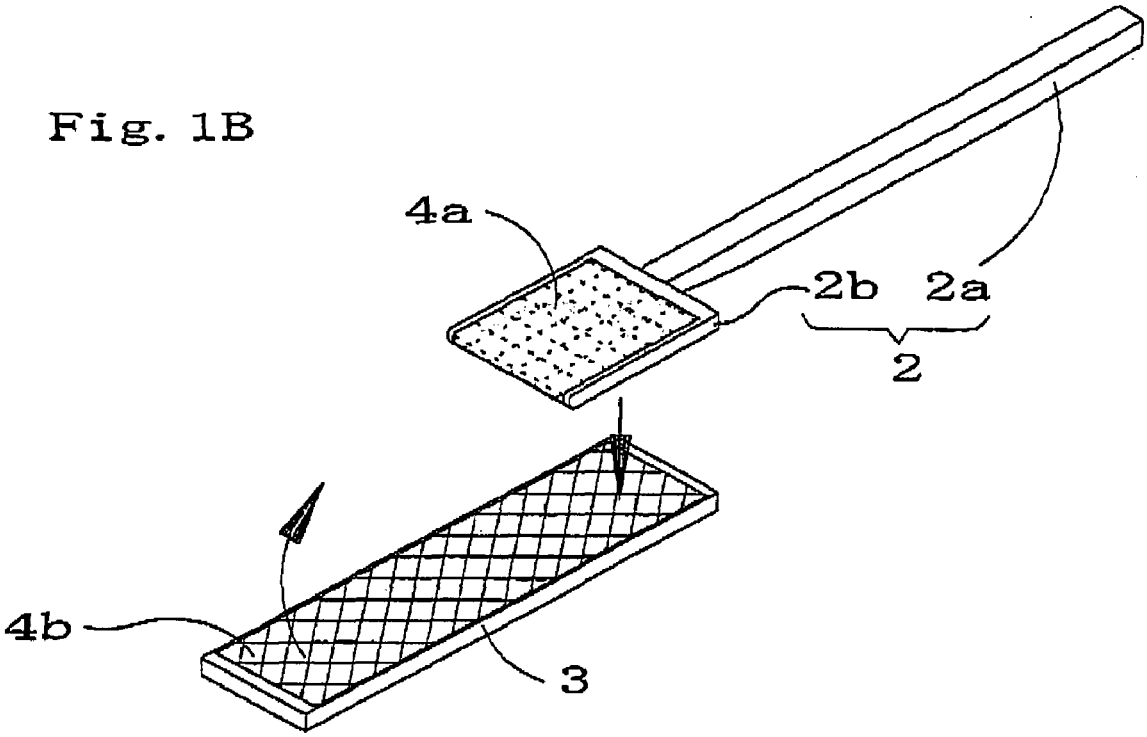

An embodiment according to the invention will be described with reference to accompanying drawings. FIGS. 1A and 1B are views showing a schematic appearance of a dressing tool according to an embodiment of the invention. A dressing tool 1 includes a grip 2 and a sponge-shaped melamine resin foam 3 (see FIG. 1). An operator can grasp the grip 2 with one hand. Since the melamine resin foam 3 is a resin in which a hard melamine resin is foamed in a micron scale to have a sponge shaped and has sufficient thermal resistance and brittleness, the melamine resin foam 3 is not burned out like a cloth and is not wound on a rotating grindstone. One sold at a market as a wiping cleaner may be used as the melamine resin foam 3, and the composition of the melamine resin foam 3 is disclosed, for example, in U.S. Pat. No. 6,503,615 (JP-A-11-128137).

Further, the dressing tool does not need to necessarily include the grip. In this case, the melamine resin foam itself serves as the dressing tool.

The grip 2 includes a rod-shaped handle 2*a* and a flat plate-shaped attachment part 2*b*, which is provided at the end of the handle 2*a*. The long plate-shaped melamine resin foam 3 is bent, and then detachably attached to the attachment part 2*b* by using attachment members 4*a* and 4*b* such as a hook-and-loop fastener or a double sided adhesive tape (see FIG. 1B). Accordingly, whenever the dressing tool 1 is used, it is possible to change the melamine resin foam 3 into a new one.

Meanwhile, the shape of the melamine resin foam 3 is not limited to the flat plate shape. In addition, the grip 2 may also have any shape as long as the operator can easily grasp the grip 2. In particular, the shape of the attachment part 2*b* may be determined on the basis of the shape of the melamine resin foam 3.

Figure 2:
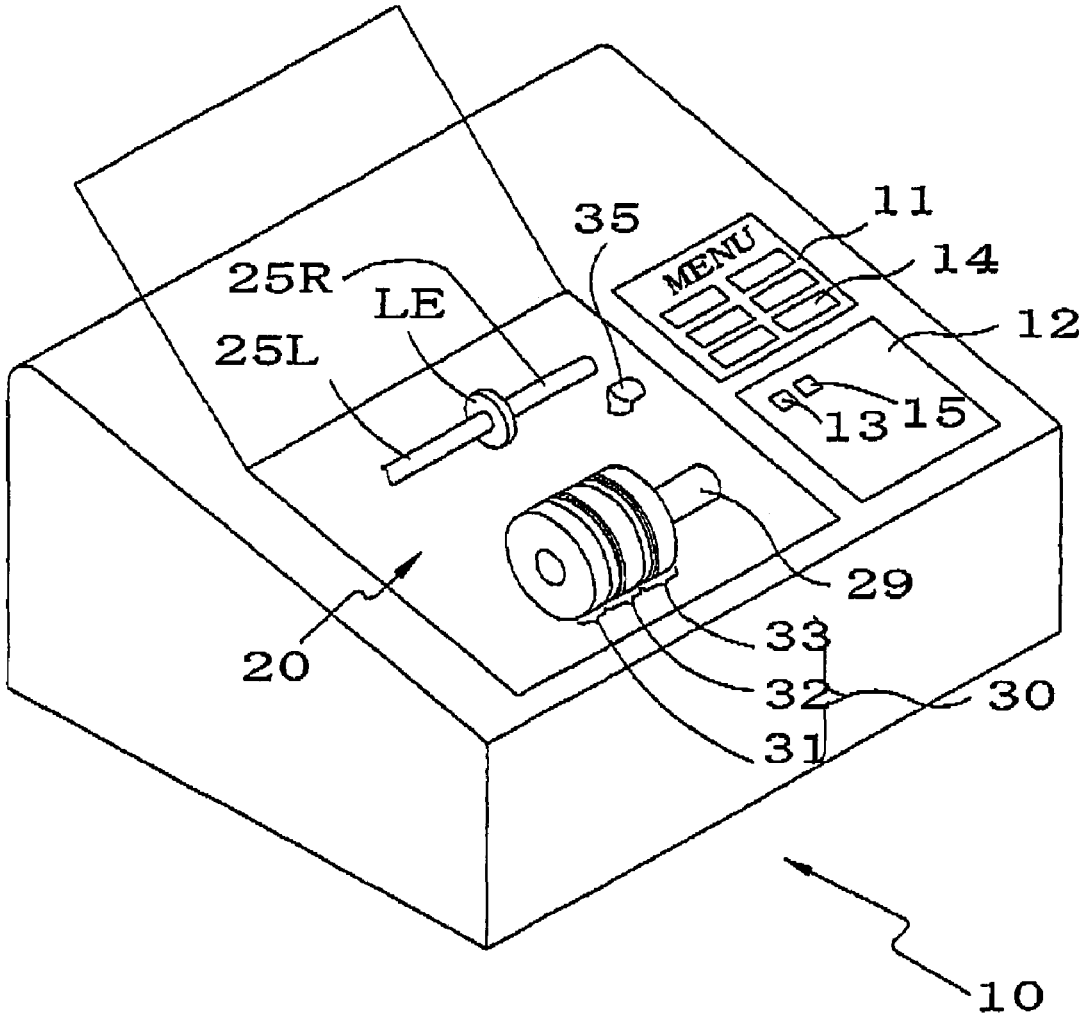
FIG. 2 is a view showing a schematic structure of an eyeglass lens processing apparatus.

It is preferable that a lateral width W1 of the long plate-shaped melamine resin foam 3 be substantially equal to a lateral width WP of a polishing grindstone (a grindstone 33 in FIG. 2). In this embodiment, the lateral width W1 is about 20 mm, and a longitudinal width W2 is about 30 mm. Further, it is preferable that a thickness T1 of the melamine resin foam 3 be large to remain after the melamine resin foam 3 is cut due to one time dressing. In this embodiment, the thickness T1 is about 5 mm. Further, the melamine resin foam 3 is provided on both surfaces of the attachment part 2*b*. For this reason, if the melamine resin foam 3 lacks on one surface of the attachment part 2*b*, the melamine resin foam 3 on the other surface of the attachment part 2*b* may be used.

FIG. 2 is a view showing a schematic structure of an eyeglass lens processing apparatus. A touch screen display 11 that is used to display processing information and input processing conditions, and a switch panel 12 are provided on the upper portion of an eyeglass lens processing apparatus 10. A processing chamber 20 is formed in the processing apparatus 10. An eyeglass lens LE is held (chucked) by lens chucks 25L and 25R and is rotated in the processing chamber 20, and is ground by a grindstone 30, which is attached to a spindle 29 and rotated. The grindstone 30 includes a roughing grindstone 31, a finishing grindstone 32, and a polishing grindstone 33. Further, a lens processing unit of the processing apparatus 10 is referred to, for example, U.S. Pat. No. 6,478,657 (JP-A-2001-18155). While the lens LE is, processed, water is injected from a nozzle 35.

The dressing of the publishing grindstone 33 performed using the dressing tool 1 will be described below. For example, application (also including impregnation) of an abrading agent 41 having a grain size of #200 is performed on the substantially entire surface of the melamine resin foam 3 in a pre-stage of a dressing step. Further, if a liquid agent having predetermined viscosity such as an abrasive compound is used as the abrading agent 41, it is possible to easily handle the abrading agent. Therefore, it is preferable that the liquid agent be used as the abrading agent.

In addition, a menu screen is displayed on the display 11 by operation of a menu switch 13 of the switch panel 12 of the processing apparatus 10. Then, the grindstone 33 (grindstone 30) is rotated at low speed (for example, about 1000 RPM) by operation of a dressing button 14 in the menu screen.

Figure 3:
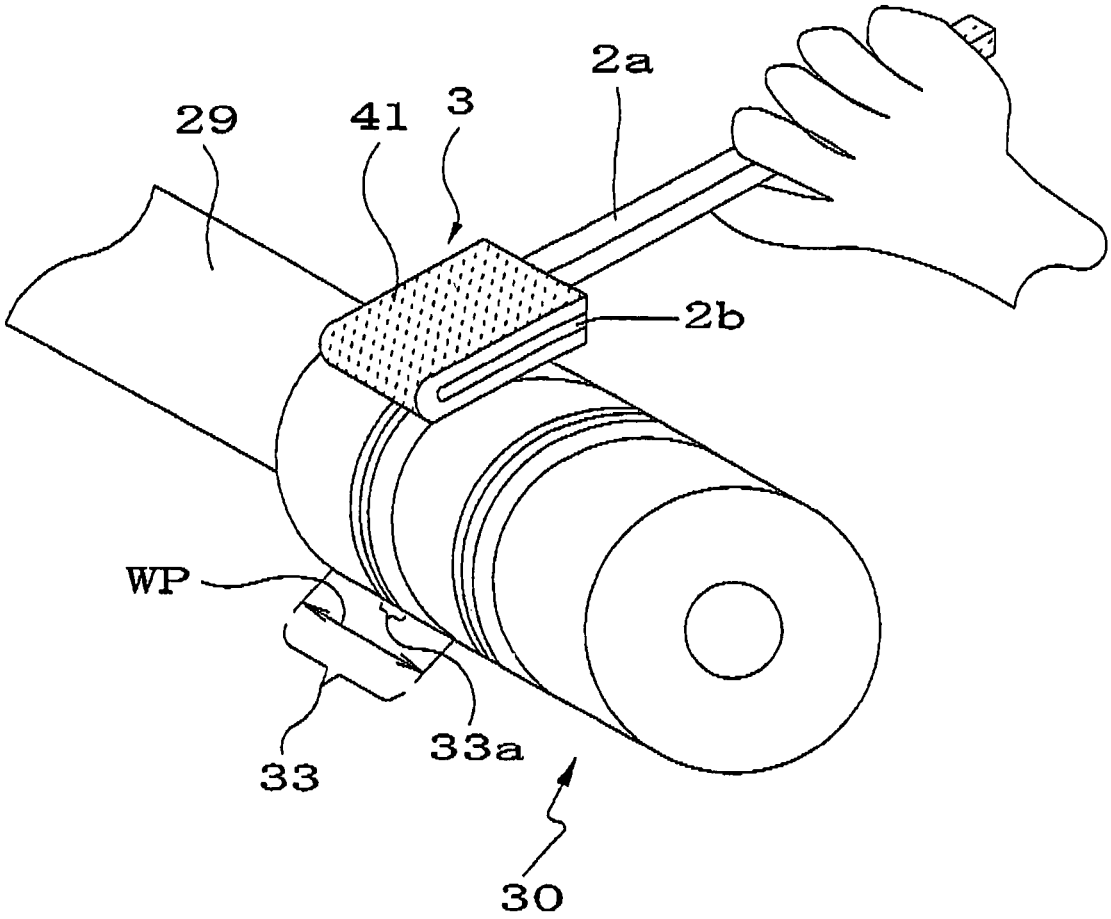
FIG. 3 is a view illustrating dressing of a polishing grindstone, which is performed by the dressing tool.

The dressing is performed by grasping the handle 2*a* of the dressing tool 1 with one hand and the pressing the melamine resin foam 3 against the rotating grindstone 33 (see FIG. 3). Since the melamine resin foam 3 is attached to the flat attachment part 2*b*, a force is evenly applied to the grindstone 33 when the melamine resin foam 3 is pressed against the grindstone 33. Further, in this embodiment, the width w1 of the melamine resin foam 3 is substantially the same as the width PW of the grindstone 33. For this reason, since the widths of the melamine resin foam 3 and grindstone 33 are set to be equal to each other, the melamine resin foam 3 does not need to be slid in a lateral direction.

Further, the melamine resin foam 3 has flexibility. For this reason, even though being slightly pressed against the grindstone 33, the melamine resin foam 3 comes in contact with a beveling groove 33*a* of the grindstone 33.

When the dressing is completed, the water is injected from the nozzle 35 to the grindstone 33 (grindstone 30) by operation of a water-discharging switch 15. Therefore, cut dust of the melamine resin foam 3 attached to the grindstone 33 are cleaned.

Meanwhile, the melamine resin foam has characteristic in which dressing is performed without the application of the abrading agent. This is due to the, fact that the melamine resin foam is formed to have minute structures of about 0.2 μm and the structures detached due to the scraping between the melamine resin foam and the grindstone serve as loose grains included in the abrading agent. Accordingly, when the abrading agent is not used, the melamine resin foam wet with water may be pressed against the rotating grindstone. However, it is preferable that the abrading agent be used in order to more reliably perform the dressing of the polishing grindstone.

Meanwhile, the polishing grindstone 33 of this embodiment has a grain size of #4000, and the abrading agent 41 has a grain size of #200. However, the grain sizes are not limited thereto.

Figure 4:
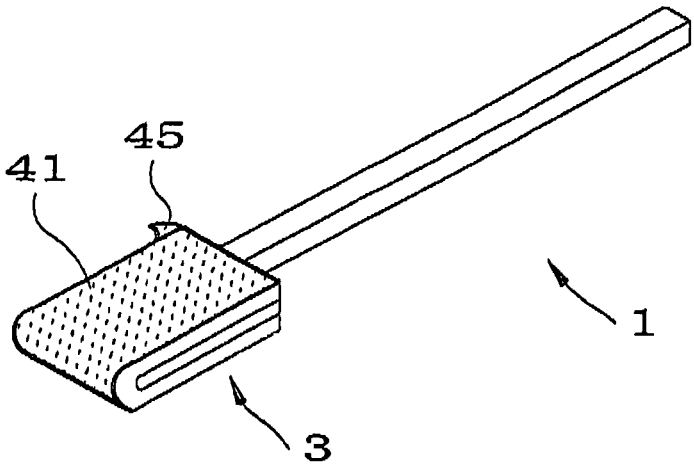
FIG. 4 is a view showing a protecting member for preventing an abrading agent, which is applied on a melamine resin foam of the dressing tool, from deteriorating.

Further, the abrading agent 41 has been applied on the melamine resin foam 3 before dressing in the above description. However, it is convenient if the melamine resin foam 3 on which the abrading agent 41 is applied (impregnated) in advance is prepared. In this case, as shown in FIG. 4, it is preferable that the melamine resin foam 3 be covered with a protecting member 45 such as a laminated sheet in order to prevent the abrading agent 41, which is applied on the melamine resin foam 3, from deteriorating.

Figure 5A:
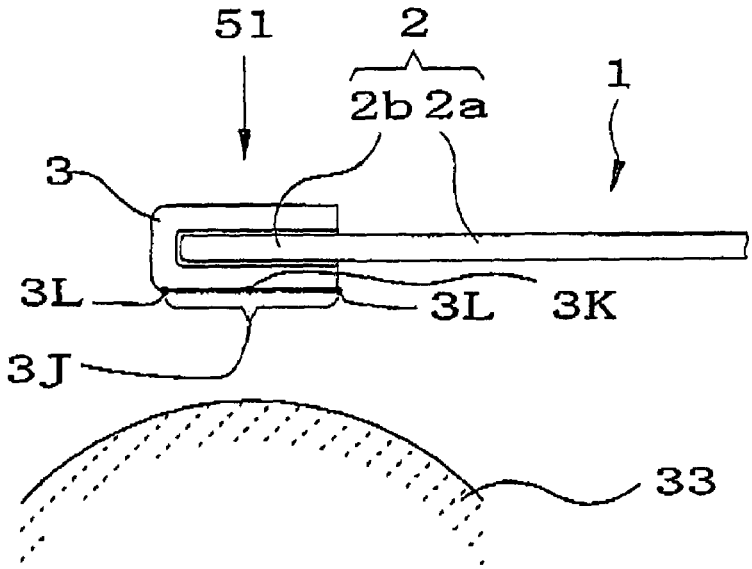
FIGS. 5A, 5B, and 5C are views showing the dressing tool and the polishing grindstone in a side view thereof.
Figure 5B:
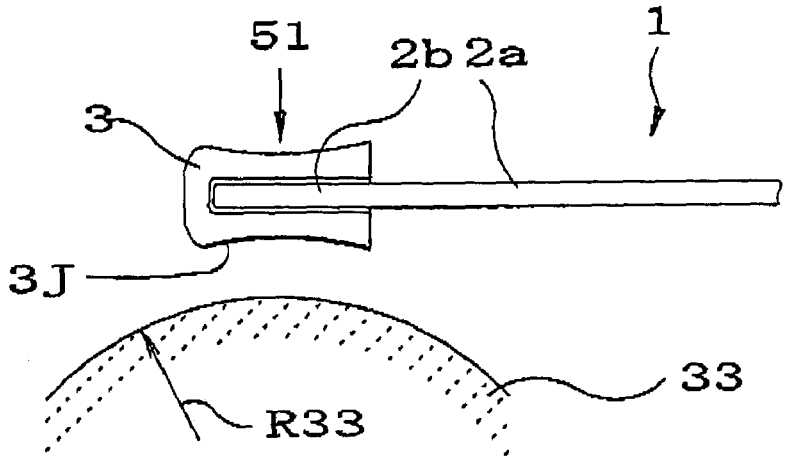
Figure 5C:
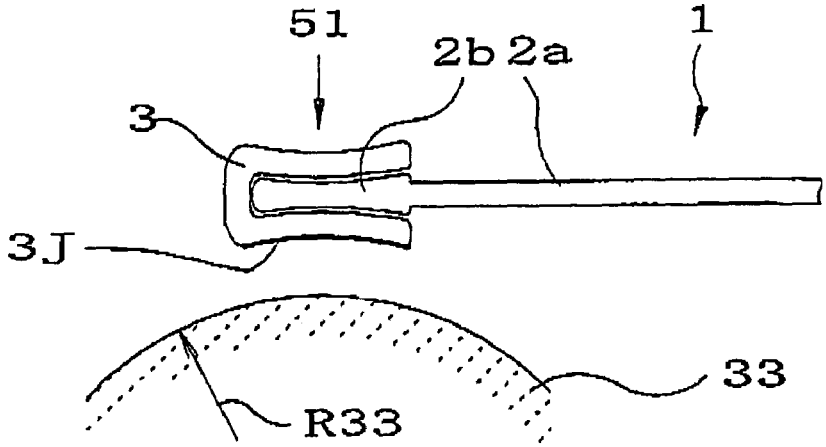

FIGS. 5A, 5B, and 5C are views showing the dressing tool 1 and the polishing grindstone 33 in a side view thereof. In FIG. 5A, a portion 3J, which comes in contact with the grindstone 33, of the melamine resin foam 3 is substantially flat. When the melamine resin foam 3 approaches the grindstone 33 in a direction indicated by an arrow 51, a center 3K of the portion 3J comes in contact with the grindstone 33 at beginning and both ends 3L of the melamine resin foam 3 then come in contact with the grindstone 33. That is, dressing is performed only in the vicinity of the center 3K, so that a portion near the center 3K is locally and significantly ground.

Meanwhile, in FIG. 5B, a portion 3J, which comes in contact with the grindstone 33, of the melamine resin foam 3 has a curved shape that substantially corresponds to a curved shape (for example, a diameter R33 of the grindstone 33 is 60 mm) of the outer peripheral surface of the grindstone 33. For this reason, when the melamine resin foam 3 approaches the grindstone 33 in the direction indicated by the arrow 51, the substantially entire portion 3J uniformly comes in contact with the grindstone 33 at the beginning.

Further, in FIG. 5C, similar to the portion 3J which comes in contact with the grindstone 33 of the melamine resin foam 3, the attachment, part 2*b* of the grip 2 also has a curved shape that substantially corresponds to the curved shape of the outer peripheral surface of the grindstone 33. For this reason, when the melamine resin foam 3 is pressed against the grindstone 33, a force is more uniformly applied to the grindstone 33.

Further, since the melamine resin foam is flexible, the curved shape of the melamine resin foam does not need to exactly correspond to the curved shape of the outer peripheral surface of the grindstone. Furthermore, the melamine resin foam may be formed to have various shapes corresponding to the various shapes of the surface of the grindstone.

Dressing of the polishing grindstone has been described in the above. However, if an abrading agent having different grain size is used, it is possible to apply the dressing tool to other grindstones.

What is claimed is:

1. A method of dressing a surface of a grindstone disposed in a processing chamber of an eyeglass lens processing a apparatus for processing an eyeglass lens, the method comprising:

rotating the grindstone, wherein a rotating speed of the grindstone at the time of dressing the grindstone is set lower than a rotating speed of the grindstone at the time of processing the eyeglass lens;

pressing a melamine resin foam, which is used as a dressing tool, against the rotating grindstone to dress the grindstone; and injecting water to the grindstone from a nozzle extended inside the processing chamber after the grindstone is dressed by the melamine resin foam to remove cut dust of the melamine resin foam attached to the grindstone, wherein the water is injected to the grindstone at the time of processing the eyeglass lens and is not injected to the grindstone at the time of dressing the grindstone.

2. The method according to claim 1, further comprising the step of:

applying or impregnating an abrading agent on the melamine resin foam.

3. The method according to claim 1, wherein, in the pressing step, the melamine resin foam having at least a portion of a surface thereof which has a curved shape substantially corresponding to a curved shape of an outer peripheral surface of a cylindrical grindstone is pressed against the rotating grindstone.

4. The method according to claim 1, wherein the method is a method of dressing a polishing grindstone.

* * * * *